US008904916B2

(12) United States Patent
Hunn et al.

(10) Patent No.: US 8,904,916 B2
(45) Date of Patent: Dec. 9, 2014

(54) BLAST RESISTANT VEHICLE HULL

(75) Inventors: David L. Hunn, Kennedale, TX (US); James C. Copp, Arlington, TX (US); Sang J. Lee, Coppell, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 446 days.

(21) Appl. No.: 13/514,531

(22) PCT Filed: Jan. 28, 2010

(86) PCT No.: PCT/US2010/022421

§ 371 (c)(1), (2), (4) Date: Aug. 9, 2012

(87) PCT Pub. No.: WO2010/123606

PCT Pub. Date: Oct. 28, 2010

(65) Prior Publication Data

US 2012/0297966 A1 Nov. 29, 2012

Related U.S. Application Data

(60) Provisional application No. 61/148,290, filed on Jan. 29, 2009.

(51) Int. Cl.
*F41H 7/04* (2006.01)

(52) U.S. Cl.
CPC . *F41H 7/042* (2013.01); *F41H 7/04* (2013.01)
USPC ..... 89/36.08; 89/36.09; 89/903; 296/187.08

(58) Field of Classification Search
USPC ..... 89/36.01, 36.02, 36.07, 36.08, 36.09, 89/1.13; 296/187.07, 187.08, 190.03; D12/12
See application file for complete search history.

(56) References Cited

U.S. PATENT DOCUMENTS

| | | | | |
|---|---|---|---|---|
| 4,460,128 | A | 7/1984 | Lazarre | |
| 5,472,378 | A * | 12/1995 | Skoff | 454/141 |
| 5,663,520 | A | 9/1997 | Ladika et al. | |
| 6,813,986 | B1 * | 11/2004 | Tafoya et al. | 86/50 |
| 7,540,227 | B2 * | 6/2009 | McCants, Jr. | 89/1.819 |
| 2005/0282064 | A1 | 12/2005 | Kim et al. | |
| 2006/0042115 | A1 * | 3/2006 | Karr et al. | 34/117 |
| 2006/0272491 | A1 | 12/2006 | Joynt | |
| 2007/0068373 | A1 * | 3/2007 | McCantas, Jr. | 89/1.11 |
| 2008/0173167 | A1 | 7/2008 | Mills et al. | |

* cited by examiner

*Primary Examiner* — Bret Hayes
(74) *Attorney, Agent, or Firm* — Beusse Wolter Sanks & Maire, P.A.; Terry M. Sanks, Esq.

(57) ABSTRACT

A blast resistant vehicle hull includes an enclosure and a blast channel extending between and through a lower, outer surface of the enclosure and a surface of the enclosure other than the lower, outer surface of the enclosure. A vehicle includes a blast resistant vehicle hull. The blast resistant vehicle hull includes an enclosure and a blast channel extending between and through a lower, outer surface of the enclosure and a surface of the enclosure other than the lower, outer surface of the enclosure.

12 Claims, 6 Drawing Sheets

BLAST RESISTANT VEHICLE HULL

TECHNICAL FIELD

The present invention relates to a blast resistant vehicle hull.

DESCRIPTION OF THE PRIOR ART

Modern combat theaters require new operational doctrines to counter unsymmetrical and unpredictable threats. Vehicles, such as tanks, personnel carriers, trucks, and the like, operating in such theaters must be light, agile, and maneuverable while protecting personnel in the vehicles from the deleterious effects of explosive blasts. Mines and improvised explosive devices pose significant threats to vehicles, and particularly to light vehicles, in today's combat theaters. The explosive characteristics of mines and improvised explosive devices vary widely, ranging from relatively small devices to large, wired bombs and artillery shells.

Conventional vehicles that have been designed to mitigate the effects of such explosive devices are large and heavy, often weighing more than 5400 kg (6 tons). Such vehicles have limited tactical utility and transportability because of their extreme weight.

Some vehicles are known to have elements, such as blast attenuators, that absorb and/or redistribute a blast impulse to reduce the likelihood that the blast will cause penetration of the vehicle or launch the vehicle into the air. If the blast wave and/or associated spall or shrapnel penetrate the vehicle, or if the vehicle is launched to a significant distance into the air, the occupants of the vehicle may be injured or the vehicle's ability to operate may be impaired.

One way of at least partially protecting a vehicle and the like from the destructive effects of explosive blasts is to provide armor on the exterior of the vehicle. Such armor typically is made from thick steel plate, which increases the weight of the vehicle substantially. The armor must be sufficiently strong to prevent the blast wave resulting from the explosive blast from penetrating or rupturing the armor.

Another way of protecting vehicles and the like from the destructive effects of explosive blasts is to add crushable elements to the vehicle. Typical crushable elements used in blast attenuators include, for example, honeycomb, foam, and/or corrugated panels that absorb the explosive blast wave. While such crushable elements are effective in absorbing blast loads, they are volumetrically inefficient. Crushable elements having large volumes are required to dissipate the energy of the explosive blast.

While protecting the vehicle or structure and its occupants and equipment is generally of primary importance, other factors may play a role in the design of blast attenuators for the vehicle. For example, it is not desirable for the vehicle's overall size to increase greatly as a result of adding blast attenuators or other such blast protection devices to the vehicle. It is logistically important for existing transportation equipment (e.g., trucks, trailers, aircraft, and the like) to be capable of transporting the vehicle. If the size of the vehicle is increased over previous vehicles, the existing transportation equipment may not be capable of transporting the vehicle, or the existing transportation equipment may be limited to carrying fewer vehicles per load. Additionally, it is desirable to maximize the internal volume of the vehicle to allow adequate space to house the crew and crew gear. Accordingly, blast attenuators having lower volumes generally result in vehicle designs having larger internal volumes. The overall size of the vehicle is also a factor in combat situations. Generally, smaller targets (i.e., smaller vehicles) are more difficult to hit with artillery, such as rockets, mortars, missiles, and the like. Thus, it is desirable for the vehicle's overall size to be smaller, rather than larger, to reduce the likelihood of an artillery hit or explosive impact.

There are many vehicles that are configured to withstand explosive blasts that are well known in the art; however, considerable room for improvement remains.

BRIEF DESCRIPTION OF THE DRAWINGS

The novel features believed characteristic of the invention are set forth in the appended claims. However, the invention itself, as well as a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1:
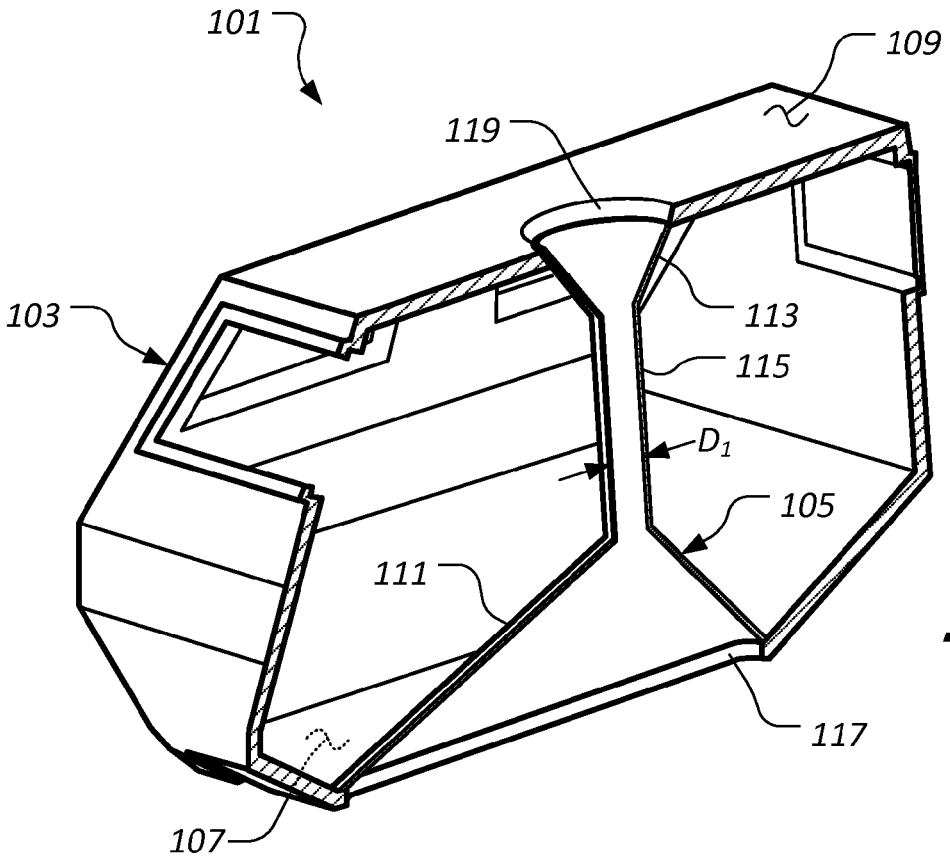
FIG. 1 is a cross-sectional, perspective view of a first illustrative embodiment of blast resistant vehicle hull.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents a vehicle hull for a ground-travelling vehicle that includes an enclosure and a blast channel extending between and through a lower, outer surface of the enclosure and a surface of the enclosure other than the lower, outer surface of the enclosure. For example, in one embodiment, the blast channel comprises a funnel, a nozzle, and a transit tube extending between and in fluid communication with the funnel and the nozzle. The funnel extends through the lower, outer surface of the enclosure. The nozzle extends through the surface of the enclosure other than the lower, outer surface of the enclosure. At least a portion of a pressure wave produced by an explosion beneath the vehicle is vented through the vehicle via the blast channel to reduce the upward force of the explosion upon the vehicle. Accelerating gases emitted from some nozzle configurations provide a downward force to resist vehicle lifting and upward movement. In one embodiment, the blast channel extends between and through the lower, outer surface of the enclosure and an upper, outer surface of the enclosure. In such an embodiment, the nozzle extends through the upper, outer surface of the enclosure. In another embodiment, the blast channel extends between the lower, outer surface of the enclosure and a side, outer surface of the enclosure. In such an embodiment, the nozzle extends through the side, outer surface of the enclosure. Preferably, the funnel defines an opening larger than the inner, cross-sectional dimension of the transit tube. The nozzle may define an opening larger, smaller, or substantially equivalent to the inner, cross-sectional dimension of the transit tube, depending upon the desired downward-force characteristics. For example, nozzles may incorporate "throat features" to accelerate explosive gases as they are emitted from such nozzles.

Figure 2:
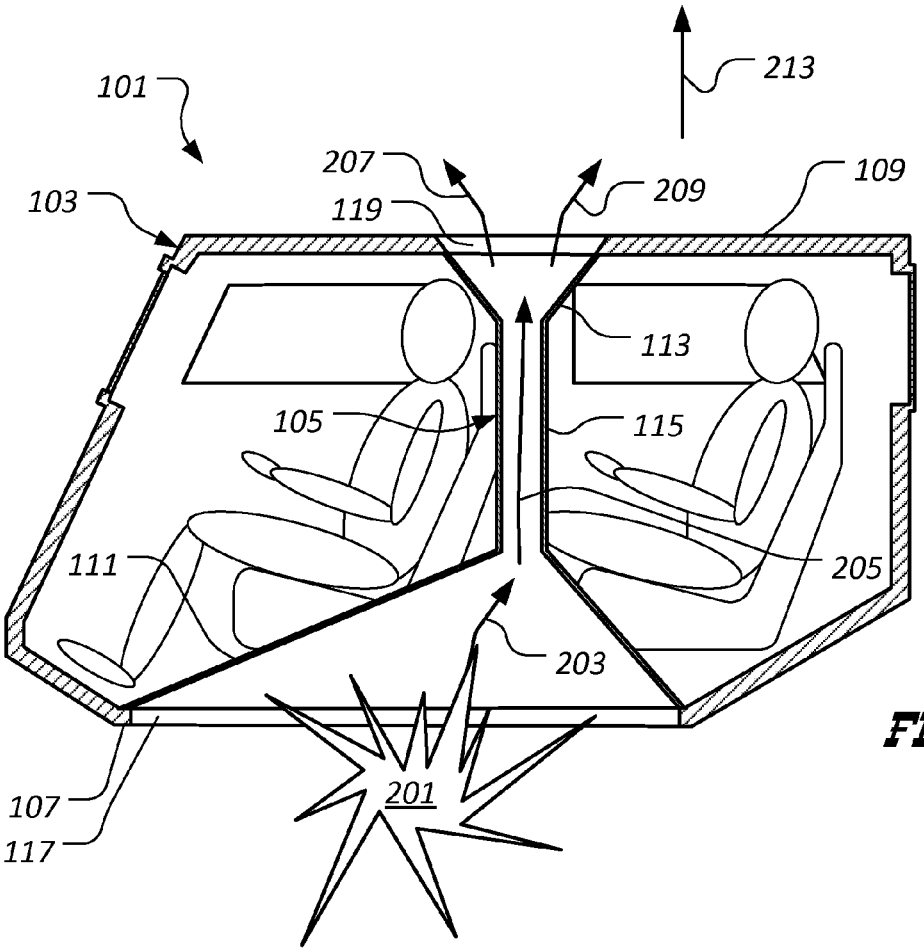
FIG. 2 is a cross-sectional, side, elevational view of the blast resistant vehicle hull embodiment of FIG. 1.

FIGS. 1 and 2 depict cross-sectional views of a first illustrative embodiment of a blast resistant vehicle hull 101 for a ground-travelling vehicle. Blast resistant vehicle hull 101 comprises an enclosure 103 for personnel and/or materiel, which may take on any suitable form. Blast resistant vehicle hull 101 further comprises a blast channel 105 extending between and through a lower, outer surface 107 of enclosure 103 and a surface of enclosure 103 other than lower, outer surface 107 of enclosure 103. In the illustrated embodiment, blast channel 105 extends between and through lower outer surface 107 of enclosure 103 and an upper, outer surface 109 of enclosure 103. Blast channel 105 comprises an inlet funnel 111, an outlet nozzle 113, and a transit tube 115 extending between and in fluid communication with inlet funnel 111 and outlet nozzle 113. Inlet funnel 111 extends through lower, outer surface 107 of enclosure 103.

Figure 4:
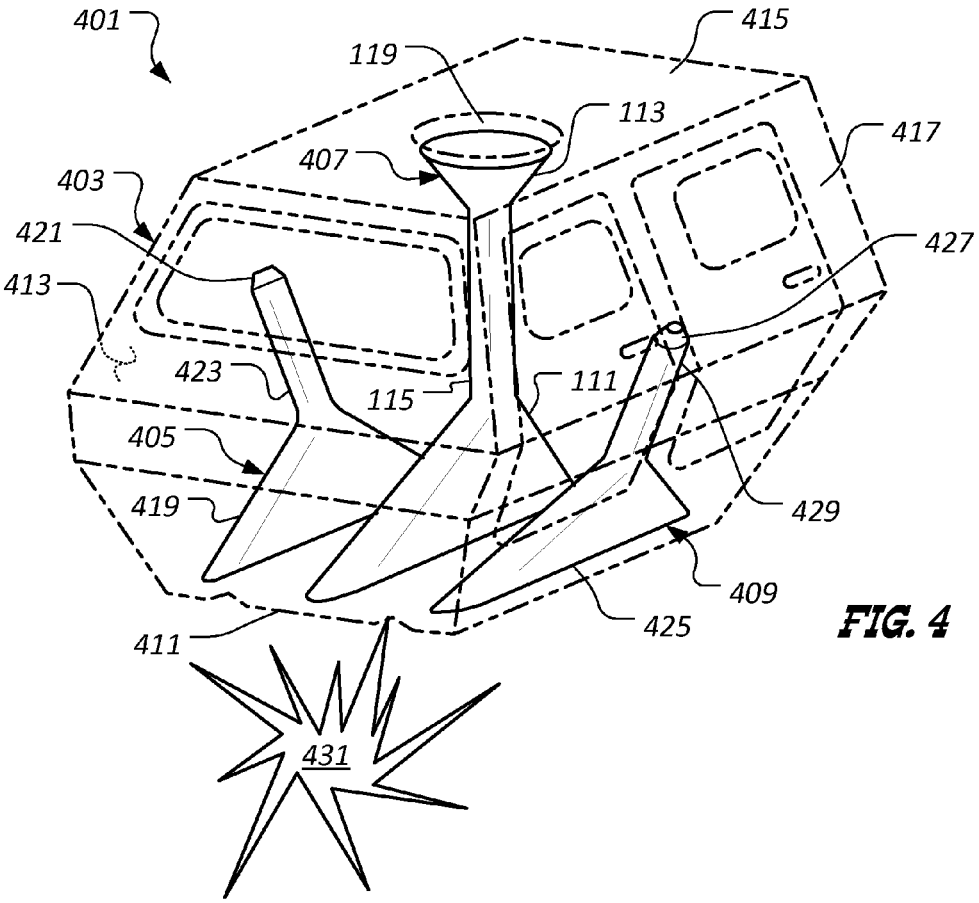
FIG. 4 is a perspective view of a second illustrative embodiment of a blast resistant vehicle hull.

In the illustrated embodiment, outlet nozzle 113 extends through upper, outer surface 109 of enclosure 103, although the present invention contemplates other configurations, such as the configuration of FIG. 4, which is discussed in greater detail herein. It should also be noted that the present invention contemplates configurations of a blast channel other than the configuration of blast channel 105. For example, in the illustrated embodiment, inlet funnel 111 presents a larger inlet opening 117 than an inner, cross-sectional dimension $D_1$ (shown only in FIG. 1) of transit tube 115; however, the present invention is not so limited. Moreover, in the illustrated embodiment, outlet nozzle 113 defines an outlet opening 119 that is larger than inner, cross-sectional dimension $D_1$ of transit tube 115. The scope of the present invention, however, includes configurations wherein outlet nozzle 113 defines an outlet opening that exhibits substantially the same dimension as or a smaller dimension than inner, cross-sectional dimension $D_1$ of transit tube 115.

FIG. 2 provides a graphical representation of an operation of blast resistant vehicle hull 101. Upon an explosion occurring beneath blast resistant vehicle hull 101, represented by a graphic 201, at least a portion of a pressure wave produced by explosion 201 is vented through enclosure 103 via blast channel 105, as represented by arrows 203, 205, 207, and 209. Accelerating gases produced by explosion 201 are emitted from outlet nozzle 119 to inhibit vehicle lifting and upward movement, represented by an arrow 213.

Figure 3:
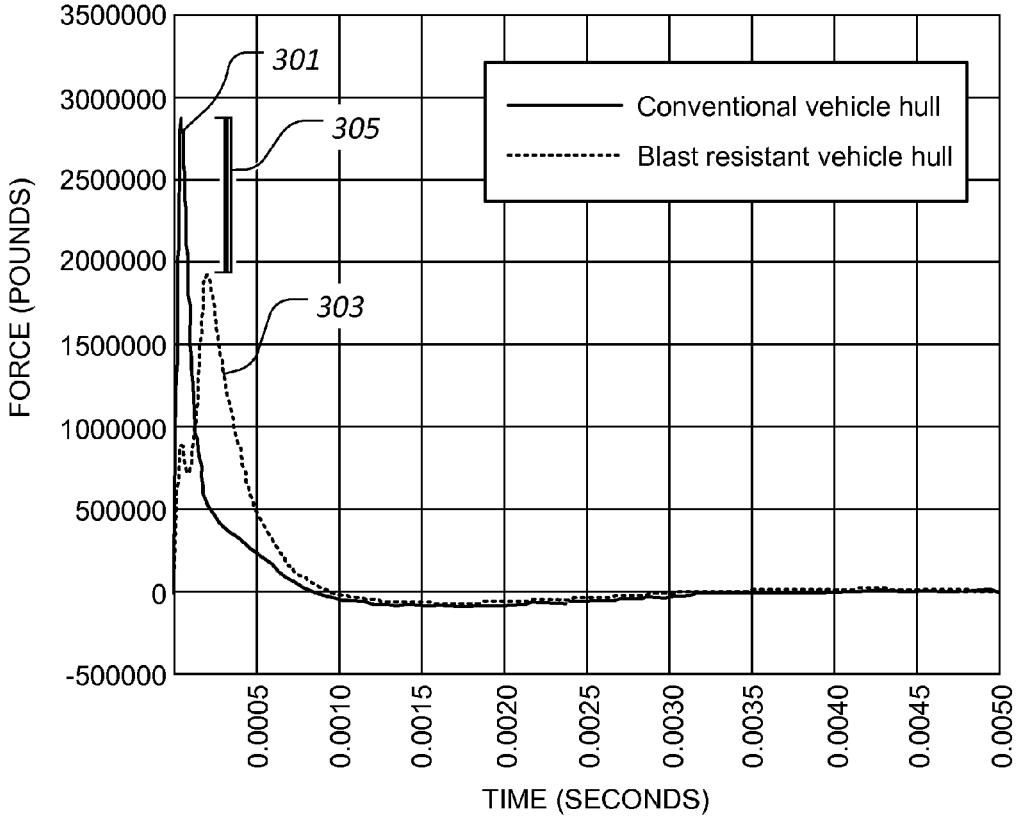
FIG. 3 is a graphical representation of a computer simulation comparing force imparted on a conventional vehicle hull and force imparted on a blast resistant vehicle hull by an explosive device.

FIG. 3 depicts a graphical representation of a computer simulation comparing force imparted upon a conventional vehicle hull and upon a blast resistant vehicle hull, such as blast resistant vehicle hull 101 of FIGS. 1 and 2 or the like, from common explosive events, such as explosion 201 of FIG. 2. In FIG. 3, a solid line represents the force imparted upon a conventional vehicle hull over time, beginning at detonation of the explosive. A dashed line represents the force imparted upon a blast resistant vehicle hull of the present invention over time, also beginning at detonation of the explosive. The peak force imparted on the blast resistant vehicle hull was about 36 percent less than the peak force imparted on the conventional vehicle hull, as indicated by bracket 305.

Figure 5:
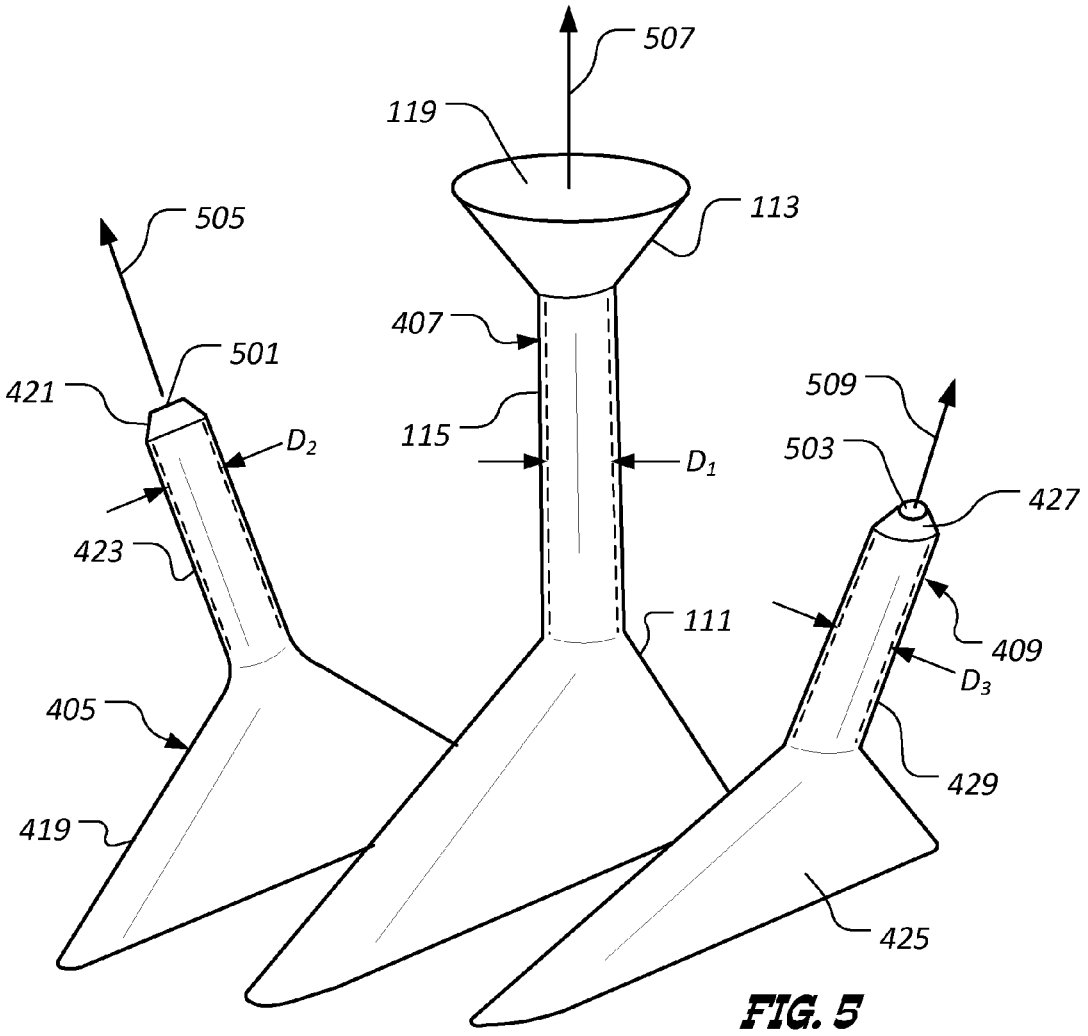
FIG. 5 is an enlarged, perspective view of the blast tubes of the embodiment of FIG. 4 in which the enclosure has been removed to better reveal the features of the blast tubes.

FIGS. 4 and 5 depict a second illustrative embodiment of a blast resistant vehicle hull 401 for a ground travelling vehicle. Blast resistant vehicle hull 401 comprises an enclosure 403, which is shown in phantom only in FIG. 4 to better reveal other aspects of blast resistant vehicle hull 401, for personnel and/or materiel, which may take on any suitable form. Note that in FIG. 5 enclosure 403 has been removed to even better reveal other aspects of blast resistant vehicle hull 401. Blast resistant vehicle hull 401 further comprises a plurality of blast channels 405, 407, and 409. While the embodiment shown in FIG. 4 depicts three blast channels, the scope of the present invention encompasses a blast resistant vehicle hull comprising any suitable number of blast channels. Blast channel 405 extends between and through an lower, outer surface 411 of enclosure 403 and a first side, outer surface 413 of enclosure 403. Blast channel 407 extends between and through lower, outer surface 411 of enclosure 403 and an upper, outer surface 415 of enclosure 403. Blast channel 409 extends between and through lower, outer surface 411 of enclosure 403 and a second side, outer surface 417 of enclosure 403.

Still referring to FIGS. 4 and 5, blast channel 407 of the illustrated embodiment has a configuration corresponding to blast channel 105 of FIGS. 1 and 2, although the present invention is not so limited. As in the embodiment of FIGS. 1 and 2, inlet funnel 111 extends through lower, outer surface 411 of enclosure 403. Outlet nozzle 113 extends through upper, outer surface 415 of enclosure 403. Blast channel 405 comprises an inlet funnel 419, an outlet nozzle 421, and a transit tube 423 extending between and in fluid communication with inlet funnel 419 and outlet nozzle 113. Inlet funnel 419 of blast channel 405 extends through lower, outer surface 411 of enclosure 403. Outlet nozzle 421 of blast channel 405 extends through first side, outer surface 413 of enclosure 403. Blast channel 407, which exhibits a mirrored configuration of blast channel 405 in the illustrated embodiment, comprises an inlet funnel 425, an outlet nozzle 427, and a transit tube 429 extending between and in fluid communication with inlet funnel 425 and outlet nozzle 427. Inlet funnel 425 of blast channel 407 extends through lower, outer surface 411 of enclosure 403. Outlet nozzle 427 of blast channel 407 extends through second side, outer surface 417 of enclosure 403. In the illustrated embodiment, outlet nozzle 421 of blast channel 405 exhibits an opening 501 that is smaller than an inner cross-sectional dimension $D_2$ of transit tube 423. Similarly, outlet nozzle 427 of blast channel 409 exhibits an opening 503 that is smaller than an inner cross-sectional dimension $D_3$ of transit tube 429. The scope of the present invention, however, includes configurations wherein outlet nozzle 421 defines an outlet opening that exhibits substantially the same dimension as or a larger dimension than inner, cross-sectional dimension $D_2$ of transit tube 423 and configurations wherein outlet nozzle 427 defines an outlet opening that exhibits substantially the same dimension as or a larger dimension than inner, cross-sectional dimension $D_3$ of transit tube 429.

Upon an explosion occurring beneath blast resistant vehicle hull 401, represented by a graphic 431, at least a portion of a pressure wave produced by explosion 431 is vented through enclosure 403 via blast channels 405, 407, and 409, as indicated by arrows 505, 507, and 509, respectively. In blast channels 405 and 409, openings 501 and 503 of nozzles 421 and 427, respectively, act as constrictions or throat features that accelerate the velocity of the gases resulting from explosion 431. Once the gases exit openings 501 and 503, the gases expand rapidly to produce reaction forces to resist vehicle lifting and rolling movement.

Figure 6:
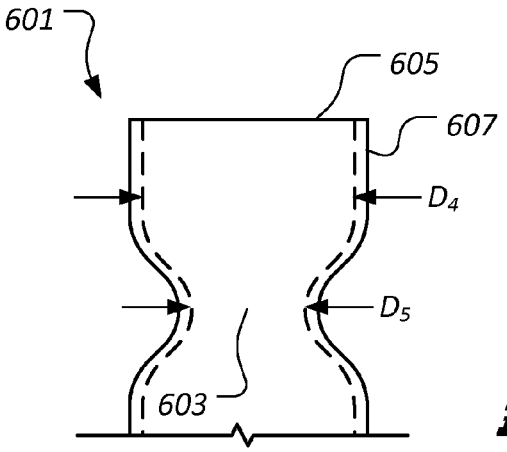
FIG. 6 is a stylized, side, elevational view of an illustrative, alternative nozzle embodiment.

A blast channel nozzle may also incorporate one or more constrictions or throat features spaced away from the outlet opening of the nozzle. FIG. 6 depicts an exemplary embodiment of such a nozzle. In the illustrated embodiment, a nozzle 601 defines a constriction 603 that is spaced away from an outlet opening 605 of nozzle 601. It should be noted that constriction 603 may be formed into nozzle 601, as shown in FIG. 6, or such a nozzle may include a constriction attached to an inner surface of the nozzle. Nozzle 601 further includes an expansion section 607, disposed between constriction 603 and outlet opening 605, in which gases accelerated by constriction 603 are allowed to expand prior to exiting nozzle 601. Note that the particular shape of expansion section 607 is merely exemplary of the many various shapes and configurations contemplated by the present invention. Expansion section 607 may take on any shape and configuration suitable for the implementation, providing that a minimum inner cross-sectional dimension $D_4$ of expansion section 607 is greater than a minimum inner cross-sectional dimension $D_5$ of constriction 603. For example, expansion section 607 may exhibit a generally consistent inner cross-sectional dimension $D_4$ or expansion section 607 may exhibit an inner cross-sectional dimension that larger at outlet opening 605 than proximate constriction 603.

It should be noted that blast channels contemplated by the present invention, such as blast channels 105, 405, 407, and 409, may be made from any material suitable for venting a pressure wave produced by an explosion beneath a blast resistant vehicle hull of the present invention. Such blast channels may be made using any suitable method.

Figure 7:
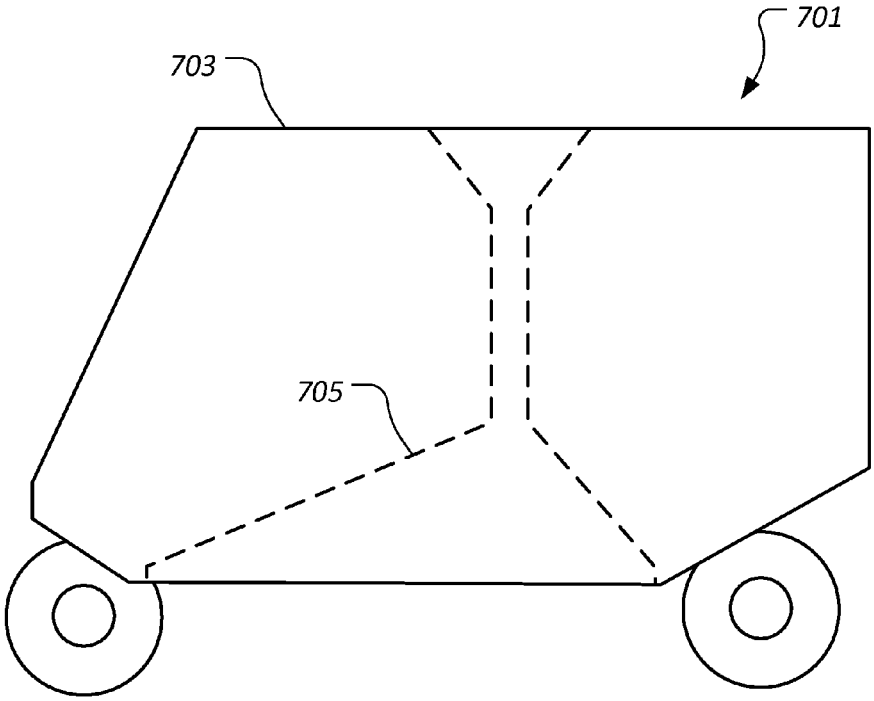
FIG. 7 is a stylized, side, elevational view of a ground-travelling vehicle that incorporates a blast resistant vehicle hull.

FIG. 7 depicts a stylized, side, elevational view of a ground-travelling vehicle 701 that incorporates a blast resistant vehicle hull 703. Note that blast resistant vehicle hull 703 may take on the form of one of blast resistant vehicle hulls 101 or 401, or another form of a blast resistant vehicle hull contemplated by the present invention. Blast resistant vehicle hull 703 comprises an enclosure and one or more blast channels 705 configured such that at least a portion of a pressure wave produced by an explosion beneath vehicle 701 is vented through vehicle 701 via blast channel 705 to reduce the upward force of the explosion upon the vehicle, as discussed herein.

The present invention provides significant advantages, including: (1) providing a vehicle hull that can better withstand blasts from mines and improvised explosive devices; (2) providing a vehicle hull that is less likely to be launched high into the air due to blasts from mines and improvised explosive devices; and (3) providing a vehicle hull that is lighter weight than conventional blast resistant vehicle hulls.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

The invention claimed is:

1. A vehicle, comprising:

a vehicle hull, comprising:

an enclosure having a lower, outer surface and other, outer surfaces configured to form a cavity for safeguarding at least one of an individual and materiel within the vehicle hull; and a blast channel configured to extend between and through the lower, outer surface of the enclosure and at least one of the other, outer surfaces of the enclosure other than the lower, outer surface of the enclosure to provide for continued safeguarding of the at least one of the individual and material located within the enclosure when an explosion occurs beneath the vehicle;

wherein the blast channel is further configured to accelerate a velocity of gases resulting from the explosion beneath the vehicle so that gases, exiting from the blast channel out through the at least one of the other, outer sides, expand rapidly.

2. The vehicle of claim 1, wherein the blast channel comprises:

a funnel extending through the lower, outer surface of the enclosure;

an outlet nozzle extending through the at least one of the other, outer surfaces of the enclosure and being configured so that gases exiting the outlet nozzle produce a reaction force to resist vehicle lifting or rolling movement attributable to the explosion; and a transit tube extending between and in fluid communication with the funnel and the nozzle.

3. The vehicle of claim 2, wherein a dimension an outlet opening defined by the nozzle is larger than an internal, cross-sectional dimension of the transit tube.

4. The vehicle of claim 2, wherein a dimension of an outlet opening defined by the nozzle is smaller than an internal, cross-sectional dimension of the transit tube and generally the same as an internal, cross-sectional dimension of the transit tube.

5. The vehicle of claim 2, wherein a dimension of an outlet opening defined by the nozzle is generally the same as an internal, cross-sectional dimension of the transit tube.

6. The vehicle of claim 2, wherein the nozzle includes a constriction or throat feature.

7. The vehicle of claim 1, wherein the at least one of the other, outer surfaces of the enclosure is an upper, outer surface of the enclosure.

8. The vehicle of claim 1, wherein the at least one of the other, outer surfaces of the enclosure is a side, outer surface of the enclosure.

9. The vehicle of claim 1, further comprising:

a second blast channel extending between and through a lower, outer surface of the enclosure and at least one of the other, outer surfaces of the enclosure.

10. The vehicle of claim 9, wherein the at least one of the other, outer surfaces of the enclosure is a side, outer surface of the enclosure.

11. The vehicle of claim 1, wherein the blast channel is configured to inhibit lifting of the vehicle during an explosion by directing and venting accelerating gases resulting from the explosion.

12. A vehicle, comprising:

a vehicle hull, comprising:

an enclosure having a lower, outer surface and a upper, outer surface, said enclosure further configured to hold an operator of the vehicle;

at least one chair within the enclosure; and a blast protection device configured as a part of the enclosure to safeguard the operator, the blast protection device comprising:

at least one blast channel having an inlet funnel, a transit tube and an outlet nozzle, the at least one blast channel extending between and through the lower, outer surface of the enclosure and the upper, outer surface of the enclosure;

wherein the at least one blast channel is configured to direct a portion of a pressure wave produced by an explosion that originates beneath the vehicle hull through the inlet funnel to the transit tube and out through the outlet nozzle so that gases exiting the outlet nozzle produce a reaction force to resist vehicle lifting or rolling movement attributable to the explosion while prohibiting spall from the explosion from reaching the operator within the enclosure.

* * * * *

UNITED STATES PATENT AND TRADEMARK OFFICE

CERTIFICATE OF CORRECTION

PATENT NO. : 8,904,916 B2
APPLICATION NO. : 13/514531
DATED : December 9, 2014
INVENTOR(S) : David L. Hunn et al.

It is certified that error appears in the above-identified patent and that said Letters Patent is hereby corrected as shown below:

In the Claims

Column 6, claim 1, line 20, delete “materiel” and insert --material--; and
claim 3, line 45, after “dimension” insert --of--.

Column 7, claim 12, line 10, delete “a upper” and insert --an upper--.

Signed and Sealed this
Seventh Day of April, 2015

Michelle K. Lee

Michelle K. Lee
*Director of the United States Patent and Trademark Office*